US009980877B2

(12) United States Patent
Konstantakis et al.

(10) Patent No.: US 9,980,877 B2
(45) Date of Patent: May 29, 2018

(54) PIPELESS WATER JET ASSEMBLY

(71) Applicant: Brooks Stevens, Inc., Allenton, WI (US)

(72) Inventors: George C. Konstantakis, Franklin, WI (US); Roberto Berritta, Rovereto (IT); Ryan M. Damm, Theresa, WI (US); Steven M. Lippincott, Van Dyne, WI (US)

(73) Assignee: Brooks Stevens, Inc., Allenton, WI (US)

( * ) Notice: Subject to any disclaimer, the term of this patent is extended or adjusted under 35 U.S.C. 154(b) by 219 days.

(21) Appl. No.: 14/733,049

(22) Filed: Jun. 8, 2015

(65) Prior Publication Data

US 2015/0352004 A1 Dec. 10, 2015

Related U.S. Application Data

(60) Provisional application No. 62/008,661, filed on Jun. 6, 2014.

(51) Int. Cl.
*E04H 4/00* (2006.01)
*A61H 33/00* (2006.01)

(52) U.S. Cl.
CPC ..... *A61H 33/6057* (2013.01); *A61H 33/0087* (2013.01); *A61H 33/6063* (2013.01)

(58) Field of Classification Search
USPC ..... 4/541.1–541.6, 507
See application file for complete search history.

(56) References Cited

U.S. PATENT DOCUMENTS 2,312,524 A 3/1943 Cox
5,742,954 A * 4/1998 Idland ..... A61H 33/6047 4/509
6,317,903 B1 * 11/2001 Brunelle ..... A61H 33/02 4/541.1
2006/0236448 A1 * 10/2006 Ciechanowski ..... A61H 33/027 4/541.6

OTHER PUBLICATIONS

Experiments on Bounded Vortex Flows and Related Particle Transport; Y. Huang and J.S. Marshall; J. Fluids Eng. 133(7), 071204 (Jul 22, 2011) (9 pages)doi:10.1115/1.4004453History: Received Dec. 14, 2010; Revised Jun. 17, 2011; Published Jul. 22 2011; Online Jul. 22, 2011—(1) page.

Formation process of the vortex ring generated by an impulsively started circular disc Yang, An-long; Jia, Lai-bing; Yin, Xie-zhen. Journal of Fluid Mechanics 713 (Dec. 25, 2012): 61-85—(1) page.

* cited by examiner

*Primary Examiner* — Lauren Crane
(74) *Attorney, Agent, or Firm* — Boyle Fredrickson, S.C.

(57) ABSTRACT

A device and method for producing pulsating waves of energy for the massaging effect normally associated with high pressure jet systems in whirlpools, pedicure spas, bathtubs and other medical and non-medical devices. The jet assembly includes no external pipes and unlike "pipeless" jet assembly systems in use today, does not require disassembly or circulation of chemical cleaning agents to maintain a sanitary condition of the jet assembly.

20 Claims, 7 Drawing Sheets

PIPELESS WATER JET ASSEMBLY

CROSS REFERENCE TO RELATED APPLICATIONS

This application claims priority to U.S. Provisional Patent Application No. 62/008,661 filed on Jun. 6, 2014 titled "Pipeless Water Jet Assembly" and the disclosure of which is incorporated herein.

FIELD OF THE INVENTION

The present invention relates to a jet assembly for generating a massaging pulse of water commonly associated with whirlpools, hot tubs, pedicure spas, swimming pools, bathtubs, medical tubs, and other such devices that are commonly subsequently cleaned and/or disinfected prior to subsequent use.

BACKGROUND OF THE INVENTION

It is generally known to provide a jet stream of water in such products as health and swim spas, whirlpools, jet stream exercisers, foot spas, bathtubs, etc. such that the stream of water can provide a massaging effect to the person positioned proximate the outflow of the jet. Such jet producing systems have been in commercial use for decades. However, all of the water jet producing devices in existence today have disadvantages including being difficult and sometimes almost impossible to thoroughly clean and/or disinfect. While it is accepted that diligent adherence to published procedures for cleaning and/or treatment can often maintain a desired level of clarity and sanitary condition of the water associated with such appliances, many such processes are commonly complicated, costly and time consuming such that such cleaning procedures are rarely strictly adhered to and/or followed.

More aggressive cleaning protocols can require the user or service personnel to disassemble pump and jet assemblies such that disassembly of pump impellers, screens and/or stators, etc, such that the cleaning process takes an inordinate amount of time and associated with the inability to use the respective appliance. Such service and cleaning down time considerations cost commercial users of such devices to lose income as well as endure the expense associated with such services and the intermediate chemical treatments. In the case of consumers, complicated cleaning procedures of piped or even pipe free water jet systems are hardly, if ever, strictly adhered to. Such inattention can result in the collection of the undesired matter in the jet system which is expelled into the user environment upon subsequent operation of the jet system.

Several actions can be taken in an attempt to overcome the difficulty of sanitation, including the addition of chemicals (e.g., bleach, chlorine, bromine) into the water to help control bacteria growth. Despite such efforts, however, water quality is sometimes still difficult to maintain. For example, bacteria can develop simple defense mechanisms such as the formation of a protective barrier or layer to counter chemical attacks. The destruction of the outer coating or barrier is generally successful with chemicals alone but most often times chemicals are only effective in destroying the outer barrier when used for extended periods of time, sometimes hours. Therefore, the preferred method of eliminating bacteria from jet pumping systems is through mechanical means such as abrasion (e.g., removal with a rag and a chemical cleanser that has anti-bacterial capabilities).

Unfortunately, many spa devices have intricate and elaborate systems of passages, cavities, orifices and pipes that move water from a pump, through a filtering system, and ultimately to one or more nozzles (e.g., openings) that deliver water back to a basin for re-circulation. In the case of a pedicure basin or whirlpool, the process of cleaning after each use involves draining the water from the system, spraying the basin with an anti-bacterial cleanser, circulating the water for a period of time, discarding the cleaning fluid, rinsing the basin, refilling with fresh water, re-circulating and draining once again. The various pipes and fittings often render it difficult if not impossible to mechanically scrub every component that comes into contact with the circulated water. Further, after a system is drained, some water commonly remains within the piping system, usually in cracks, crevices, and low portions of the circulation loop. For example, the pump itself is usually a sealed unit that may be difficult to completely drain. It is within these areas that bacteria tend to grow the outer barrier coating as a defensive mechanism against attack from anti-bacterial chemicals, especially when the system is not used for extended periods (e.g., overnight, weekends, etc.). Consequently, water quality may be diminished in conventional piped systems that are not effectively cleaned.

Another consideration to jet system constructions is that the jet streams produced by all systems in existence today rely on a high velocity, low mass flow stream to impart a massaging effect. The jet streams produced are harsh and can become uncomfortable after only a few minutes of use. Generally, people will sit in the jet stream for only a short period of time and then turn the jets off or remove themselves from the stream or, for those systems that include adjustable jets, reduce the velocity of the jet stream to levels that can be tolerated for longer durations. Such actions commonly satisfy the desires of one user to the detriment of the desires of other users.

The sometimes harsh massaging effect associated with many spa systems is commonly generated by pointing a small number of nozzles (e.g., openings) toward the body of the user. These nozzles are generally connected via pipes and hoses to a single centrifugal pump that produces a very high pressure (20-40 psi) and a relatively low volume of water. Many customers often complain that the jets of water produced in this manner are too rough, in some cases even producing pain or discomfort. Although the jets can be partially closed to reduce the force of the water stream, this also reduces the volume of water communicated from the discrete jets. Consequently, the massage effect is reduced since the jets are often a considerable distance away from the body (e.g., in the walls of the basin).

U.S. Pat. No. 2,312,524 to Cox discloses one example of a foot bathing device that utilizes foot rests that consist of a disk of heavy wire screening or a perforated plate. This type of system can have several disadvantages including producing unrestricted streams of water. For example. Cox discloses the use of a flat foot rest containing a uniform pattern of openings across the entire foot rest that is not capable of directing the water in any particular direction (e.g., a foot rest that includes a uniform grid pattern across the entire foot rest).

Therefore, there is a need for jet assembly that generates a desired massage effect and that mitigates some of the sanitation problems disclosed above. Further, it would be advantageous to provide an apparatus that does not require disassembly in order to achieve adequate disinfection. It would be further advantageous to have a device that produced a very large volume of water flow with very little pressure so that the massaging effect would not become uncomfortable after relatively short periods of exposure to same. It would also be advantageous to provide a massaging jet assembly that can be fluidly isolated for the contents of the basin to simplify winterization of such devices. Finally, it would also be advantageous to more efficiently create a pulsation of water so that the cost associated with operation of the water movement or pumping apparatus could be reduced.

SUMMARY OF THE INVENTION

The present invention discloses a water jet pumping apparatus or device that overcomes one or more of the shortcomings discussed above. One aspect of the invention discloses a water jet assembly having a faceplate that defines an inlet and an outlet and a base constructed to cooperate with the faceplate. A diaphragm is disposed between the base and the faceplate and configured to cooperate with the faceplate to be movable between a first position wherein the diaphragm interferes with passage of a fluid through one of the inlet and the outlet and a second position offset from the faceplate to define a volume therebetween. An exciter is connected to the base and configured to excite the diaphragm to move fluid from the inlet to the outlet during operation of the exciter and such that the diaphragm occupies the volume when the exciter is off.

Another aspect of the invention useable with one or more of the features of the aspects above discloses a water jet assembly that includes a housing that is constructed to cooperate with a faceplate. The faceplate defines a plurality of inlets that are oriented radially about at least one outlet. The water jet assembly includes a diaphragm that is movable between a first position and a second position and disposed between the housing and the faceplate. The diaphragm obstructs the plurality of inlets and the at least one outlet when it is in the first position and defines a fluid passage between the diaphragm and the faceplate that extends between the plurality of inlets and the at least one outlet when the diaphragm is in the second position. An exciter is supported by the housing is configured to oscillate the diaphragm between the first position and the second position to move fluid from the plurality of inlets to the outlet via, the fluid passage during operation of the exciter and such that the diaphragm obstructs the plurality of inlets and the at least one outlet when the exciter is off.

Another aspect of the invention discloses a method of forming a water jet flow that includes drawing water into a variable volume chamber of a jet assembly and expelling water out of the variable volume chamber of the jet assembly by operation of an exciter. The smallest volume of the chamber is occupied by a diaphragm when the exciter is off such that water is not retained internal to the jet assembly when the jet is not operated.

Preferably, the water jet apparatus according to the present invention provides a means for pumping fluid while utilizing a torroidal soliton effect. Another feature of the present invention is to provide a means to pump water with a device that does not require disassembly to maintain proper cleaning or a desired sanitation of the jet assembly. Another feature of the present invention is to provide a means to create the effect of pumping large volumes of water without actually pumping large volumes of water. Another feature of the present invention is to provide a means to provide a massaging feel that is greatly improved over current technology. Another feature of the present invention is to force nearly or all of the entrained water out of the jet assembly when not operating.

Another feature of the present invention provides a means to destroy bacteria that may remain in the pumping mechanism through the use of silver or other suitable alternative plating or antibacterial materials on the internal surfaces associated with the pumping activity. Another feature of the present invention is to provide a water jet apparatus that does not require circulation pipes or pumps between the inlet and the outlet of the discrete jet assemblies. Such a consideration mitigates bacterial problems common to spa and hot tub assemblies that include a plurality of jets whose operation is associated with a primary pump associated with hidden plumbing features.

Another feature of the present invention is to provide an apparatus that can be properly disinfected after use without physical scrubbing or cleaning and/or without disassembly of the discrete jet flow generating devices. Another feature of the present invention is to provide a spa apparatus that does not have a single continuous elongated flow of water directed into and then out of the respective water jet devices and which can cause undesirable materials to be delivered and/or re-circulated by water and/or air jet systems. Another aspect or feature of the device is to provide a massaging effect that is unlike any other device in use today and which commonly requires high volume and high velocity water flows.

These and other aspects and features of the present invention will be more fully understood from the following detailed description and the enclosed drawings.

Figure 1:
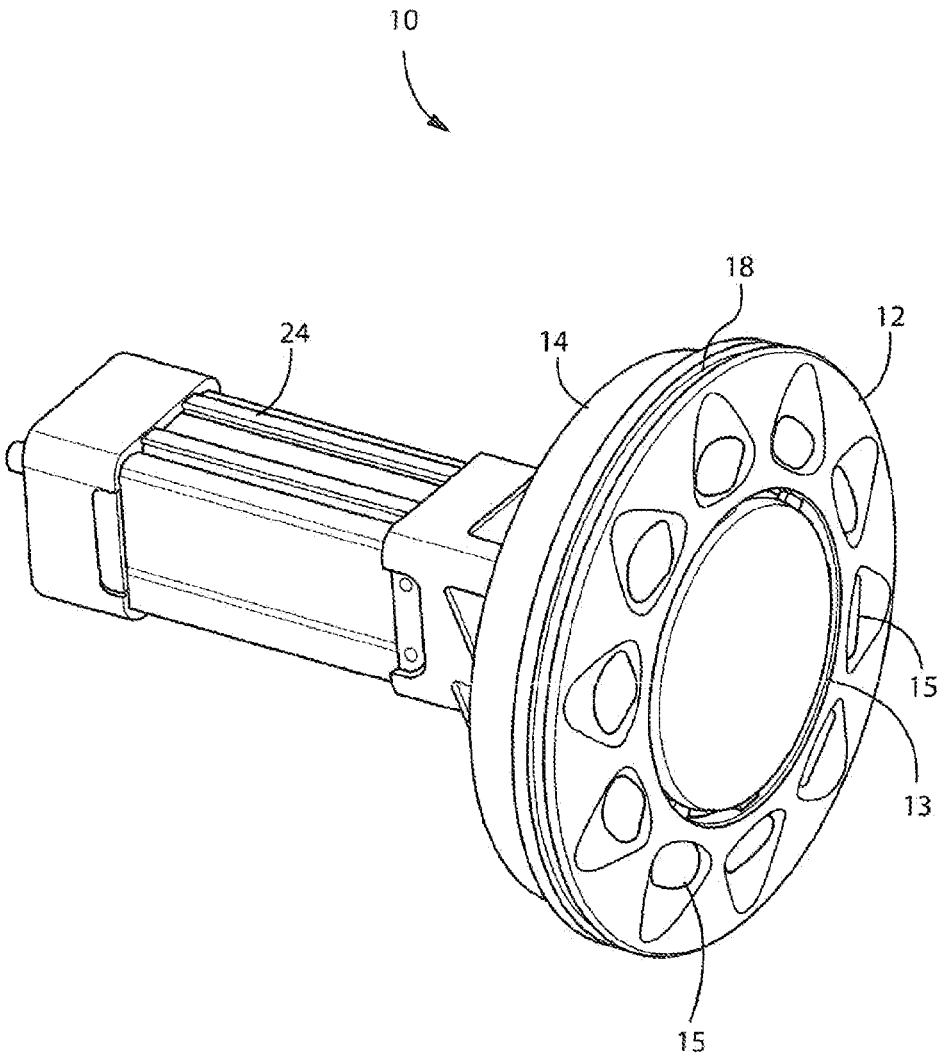
FIG. 1 is a perspective view of a jet assembly according to one embodiment of the present invention.

Before describing any preferred, exemplary, and/or alternative embodiments of the invention in detail, it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION

It is appreciated that, while the disclosed embodiments are illustrated as a jet apparatus designed for bathtubs, spas, whirlpools, hot tubs and the like, the present invention discloses and includes features that have a much wider applicability. For instance, it is appreciated that the present invention is usable with various tub, pool, and/or spa designs which can be adapted for various uses such as hand spas, other body parts, entire bodies, one or multiple persons, etc. Further, the size and relative orientation of the various components and the size of the apparatus can be widely varied.

It is further appreciated that the particular materials used to construct the exemplary embodiments are also illustrative. Components of the device, assembly, or apparatus can be manufactured from thermoplastic resins such as injection molded high density polyethylene, polypropylene, other polyethylenes, acrylonitrile butadiene styrene ("ABS"), polyurethane, nylon any of a variety of homopolymer plastics, copolymer plastics, plastics with special additives, filled plastics, etc. Also, various molding operations may be used to form these components, such as blow molding, injection or cast molding, rotational molding, etc. In addition, various components of the jet assembly and/or spa apparatus can be manufactured from stamped alloy materials such as steel or aluminum, or other metallic materials.

Figure 4:
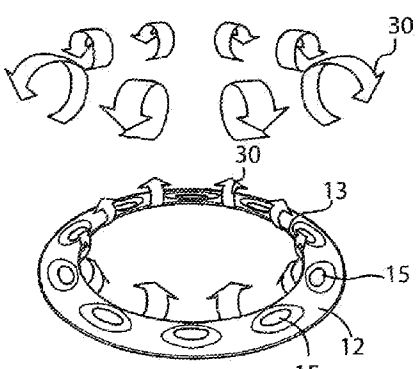
FIGS. 3 and 4 are perspective views of a faceplate of the jet assembly shown in FIG. 1 with an indication of a water flow associated with operation of the jet assembly.
Figure 5:
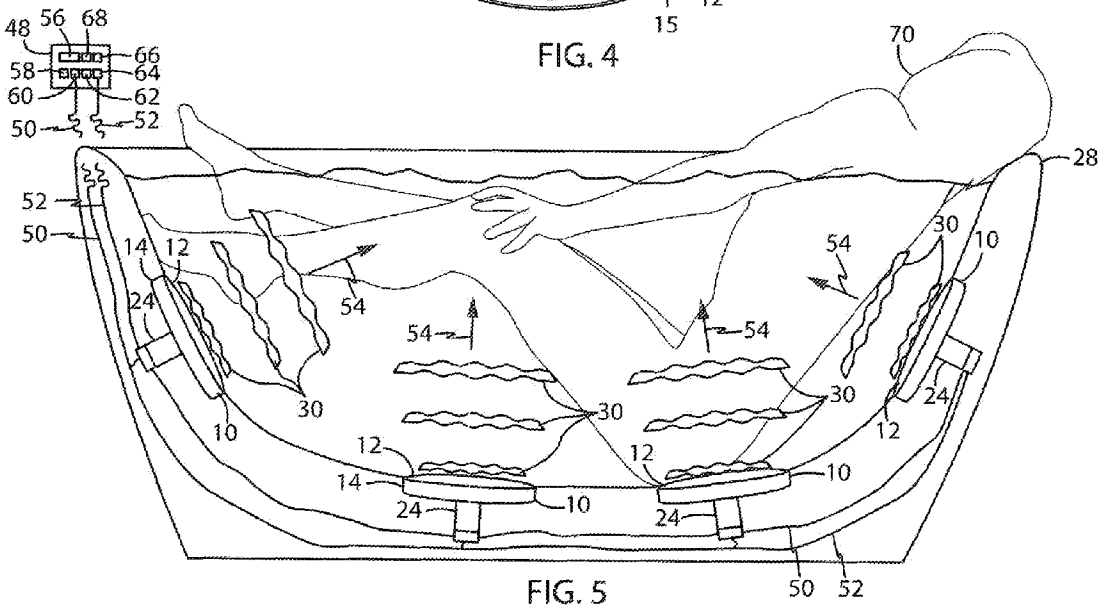
FIG. 5 is a sectional view of a basin, such as a hot tub, equipped with multiple jet assemblies as shown in FIG. 1.

Proceeding now to descriptions of the preferred and exemplary embodiments, FIGS. 1-5 show various views of a water jet device or assembly 10 and a basin, hot tub, bath tub, or spa equipped with multiple water jet assemblies according to one embodiment of the present invention. Although usable in a plurality of environments as alluded to above, jet assembly 10 is configured for use in fluid environments such as basins, pools, whirlpools, hot tubs, bathtubs, spas, and the like, as described further below and as shown in FIG. 5.

Referring to FIGS. 1-4, jet assembly 10 includes a faceplate 12 that is constructed to cooperate with a housing or base 14. Faceplate 12 defines an outlet 13 and a plurality of inlets 15 associated with generating a toroidal shaped water jet stream as disclosed further below. A diaphragm 16 is disposed between faceplate 12 and base 14. A seal 118 extends about a circumference of diaphragm 16 and is disposed between faceplate 12 and base 14. A flap assembly or arrangement 20 is disposed between base 14 and diaphragm 16. Faceplate 12 and base 14 cooperate with one another to define a chamber 22 that is shaped to accommodate motion of diaphragm 16 as disclosed further below. One lateral side of diaphragm 16 is exposed to the working fluid associated with jet assembly 10 whereas the opposite side of diaphragm 16 is fluidly isolated from the working fluid via a circumferential sealed cooperation between diaphragm 16, faceplate 12, and base 14.

Jet assembly 10 includes an exciter 24 whose operation manipulates the position of diaphragm 16 relative to faceplate 12. Exciter 24 imparts motion to or oscillates diaphragm 116 to facilitate the generation of the water jet stream. Exciter 24 can be provided in any number of forms such as a solenoid, a piston pump, a linear actuator, a rotational actuator, a speaker coil, etc. It is further appreciated that each respective exciter 24 can be physically connected to a corresponding diaphragm 16 to effectuate the desired movement of the diaphragm or positionally associated therewith such that a vacuum or other pressure signal can be utilized to effectuate motion of diaphragm 26 in response to operation of the respective exciter 24.

Jet assembly 10 pumps a very small amount of fluid that travels through the medium, in this case water, as if it was a large pulse of energy, a "wave" if you will. This effect is known in scientific communities as the torroidal soliton effect and was first characterized in mathematics and physics. A soliton is a self-reinforcing solitary wave (a wave packet or pulse) that maintains its shape while it travels at constant speed. Solitons are caused by a cancellation of nonlinear and dispersive effects in the medium. Dispersive effects refer to dispersion relations between the frequency and the speed of the waves. The soliton phenomenon was first described by John Scott Russell (1808-1882) who observed a solitary wave in the Union Canal in Scotland. Russell reproduced the phenomenon in a wave tank and named it the "Wave of Translation".

In fluid dynamics such waves are commonly referred to as Scott Russell solitary wave or solitons. Such waves are stable, and can travel over very large distances thereby providing a unique advantage in whirlpools, pools, bathtubs, etc. The term "toroidal" or torus refers to the three dimension doughnut shape of the soliton wave as it moves in a generally outward linear direction away from the origin of the soliton wave form or a direction generally aligned with an axis normal to an imaginary plane defined by the faceplate. It is appreciated that the soliton wave form can be provided as any of a ring torus, horn torus, or spindle torus, or other poly sided toroidal shapes for example, by manipulation of shape, size, and construction of the faceplate and/or inlets and outlets associated therewith, and/or via manipulation of the rate and/or amplitude associated with operation of exciter 24 and the diaphragm 16 associated therewith. Regardless of the shape, jet assembly 10 generates a soliton wave that travels in a generally outward directions, indicated by arrows 54 (FIG. 5) normal to the plane associated with faceplate 12 to generate the massaging effect associated with operation of each discrete jet assembly 10.

These and other advantages and features of the present invention are accomplished (individually, collectively, or in various subcombinations) as described below. In one embodiment of the invention, a basin 28 shaped to retain a fluid includes one or more holes or openings shaped to provide for the attachment of multiple discrete water jet assemblies 10—as shown schematically in FIG. 5.

In its simplest form, the exciter 24 associated with each water jet assembly 10 is provided as a piston pump or linear actuator that is configured to control operation of diaphragm 16 relative to a respective faceplate 12 that defines an orificed outlet. To produce the soliton effect, the volume of water displaced by operation of the piston in a unit of time is sized to work in concert with the diameter of the orifice. If the velocity of the water exiting the orifice is too low, the flow will not separate and "roll" into a donut like or toroid shape soliton. When the flow through the orifice is properly configured, a rolling donut of energy forms and that rolling donut soliton wave can travel for long distances without losing the energy in the wave. In this way each water jet assembly 10 can provide for a pleasing pulse of massage with minimal energy input.

Operation of the piston is tuned to provide a dwell or delay between generation of successive soliton waves after expelling the previous pulse of water such that the retraction associated with operation of the piston does not "suck" the torroidal flow backward and destroy some, and in some cases all, of the energy associated with the respective soliton wave. The inlets 15 and outlet 13 are shaped to mitigate interference between the incoming and outgoing fluid flows. Accordingly, the piston associated with operation of exciter 24 is allowed to dwell at the top of the travel path thereby allowing each discrete soliton wave 30 to move away from the orifice associated with outlet 13.

Additionally, retraction of a piston associated with the respective exciter 24 pulls a new pulse of water from the bathing environment into the pumping cavity via retraction of diaphragm 16 relative to inlets 15. Inlets 15 are dispersed circumferentially about faceplate 12 and radially outboard of outlet 13 to mitigate undesirable sucking of anything other than water into each water jet assembly 10 and degradation of the discrete soliton waves attributable to the incoming water stream. Check valves or flap assembly or arrangement 20 mitigate the ability of water to exit the pumping cavity or area immediately behind faceplate 12 and adjacent diaphragm 16 except through outlets 13. That is, flap arrangement 20 and diaphragm 16 cooperate with one another such that a fluid path associated with inlets 15 is interrupted prior to interruption of outlet 13 during translation of diaphragm 16 toward an inward facing surface 40 of faceplate 12.

Conversely, during intake operation, flap arrangement 20 and diaphragm 16 cooperate with the interior facing surface of faceplate 12 such that obstruction of the fluid path associated with inlets 15 is opened prior to diaphragm 16 achieving a spaced relationship relative to outlet 13. Such a consideration achieves the desired common fluid flow direction through each jet assembly 10 during operation of the discrete jet assemblies 10. When not operating, diaphragm 16 cooperates with the inward facing surface 40 of faceplate 12 such that diaphragm 16 occupies the void or flow path associated with the water flow path between inlets 15 and outlet 13 associated with the jet pumping operation. Such a construction mitigates the retention of environment water within the workings of jet assemblies 10 when the jet assemblies are not operated. Preferably, one or more of at least the working fluid exposed surfaces of faceplate 12, diaphragm 16, and/or base are coated with a silver layer or other suitable antibacterial material or coating to further mitigate existence or propagation of bacteria growth.

Figure 2:
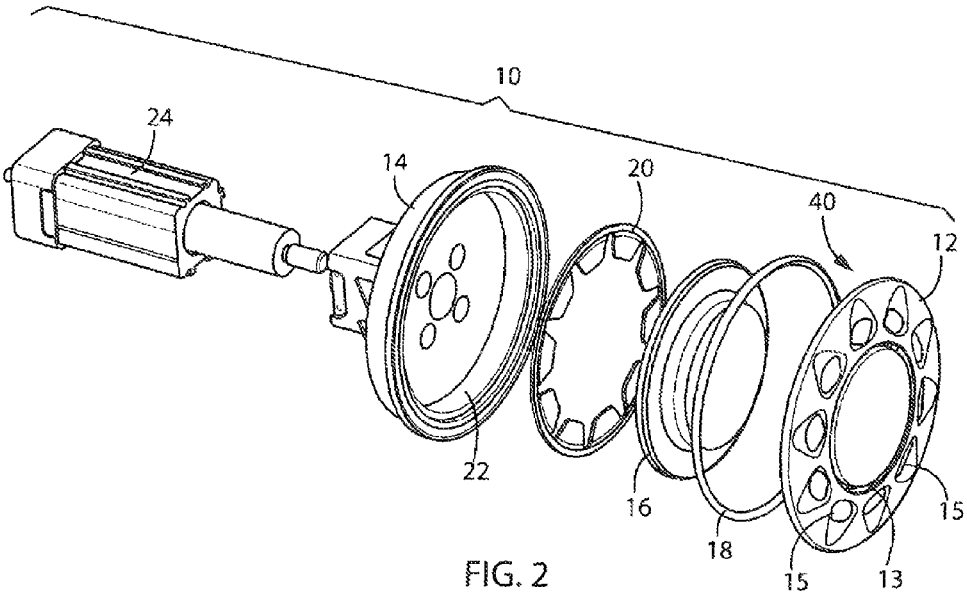
FIG. 2 is an exploded perspective view of the jet assembly shown in FIG. 1.
Figure 2B:
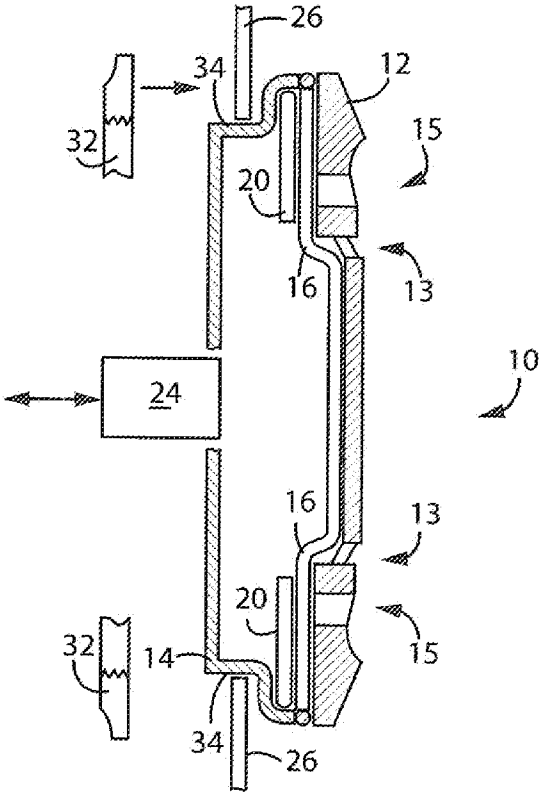
FIG. 2B is a longitudinal cross section view of the jet assembly shown in FIG. 1 with a graphical representation of the exciter associated therewith.
Figure 3:
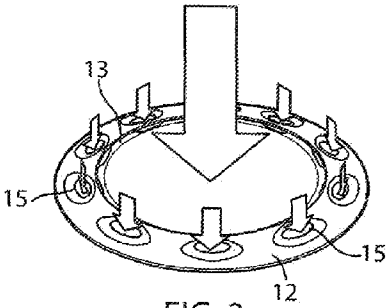

Referring to FIGS. 3-5, it is envisioned that basin 28 can include a plurality of jet assemblies 10. Although shown as a tub or spa, it is further appreciated that basin 28 can be provided in a variety of shapes and configured to accommodate an entire body or just portions thereof. It is further appreciated that each jet assembly 10 can be constructed to cooperate with basin 28 in a sealed manner. As shown in FIG. 2B, a wall 27 of basin 28 includes one or more openings configured to slideably receive a respective water jet assembly 10. A nut 32 or other securing arrangement rotationally cooperates with an external surface 34 of housing or base 14 such that wall 27 of basin 28 can be secured to basin 28 in a sealed manner. It is appreciated that nut 32 could be provided to cooperate with a structure of water jet assembly 10 that is internal or external to basin 28. It is further appreciated that basin 28 could include a threaded or other interference interface about the perimeter of each opening configured to receive a respective water jet assembly 10 in a sealed manner. It is further appreciated that the sealed interaction between each jet assembly 10 and basin 28 can be provided at an interface between base 14 and faceplate 12 or other structure associated with each discrete jet assembly 10 and basin 28. It is further appreciated that extraneous securing structures, such as nut 32, can be configured to cooperate with the respective jet assemblies 10 from directions internal to the basin or external thereto.

Regardless of the specific mounting arrangement, each jet assembly 10 is connected to a control system 48 configured to control operation of the discrete exciters 24 and the jet assembly 10 associated therewith. Although each jet assembly 10 is fluidly isolated from the other jet assemblies, aside from being exposed to the working fluid associated with basin 28, each jet assembly 10 is connected to control system 48 by one or more elongated connectors 50, 52, such as wires or pneumatic tubing to communicate the desired operating instructions to the discrete jet assemblies 10 to achieve a desired output or massage action associated with operation of the respective jet assemblies 10.

Control system 48 preferably includes a display 56 and one or more inputs 58, 60, 62, 64, 66, 68 configured to allow a user 70 to generate a desired output or massage affect associated with utilization of basin 28. Preferably control system 48 allows a limited degree of adjustability associated with the amplitude and/or frequency associated with the generation of the discrete soliton waves 30 during utilization of basin 28. It is appreciated that control system 48 can also be configured to allow the operation of only selected or desired jet assemblies 10 to satisfy different user preferences. When provided in such a methodology, it is further appreciated that the respective jet assemblies designated as preferably providing no massage effect, default to an "OFF" condition wherein the diaphragm obstructs both the outlet 13 and inlets 15 associated with a discrete jet assembly thereby isolating the internal workings of the same from the operating environment, or be allowed to operate at a frequency and/or an amplitude wherein the discrete jet assembly 10 does not generate a soliton wave 30 having an amplitude perceptible by a user 70. It should be appreciated that the operation of each discrete jet assembly 10 can be adjusted to manipulate the amplitude and or frequency of the soliton wave 30 such that the wave collapses before impinging on user 70 of basin 28. Such a consideration allows basin 28 to provide various preferred massaging effects to satisfy preferences specific to different users of basin 28.

It should be appreciated that exciter 24 associated with jet assemblies 10 can be provided in a variety of forms configured to generate the oscillated operation of diaphragm 26. It should be appreciated, from the generally elongated shape, that exciter 24 shown in FIG. 1 is commonly referred to as a linear actuator that includes a driven element that translates in a direction generally aligned with the elongated shape of the exciter. Understandably, it may periodically be desired, or even necessary, to provide the desired operation of diaphragm 16 in a more compact of alternate configuration to accommodate use of soliton water jet assemblies under various spatial constraints. FIGS. 6-9 show various views of some such exemplary exciter configurations.

Figure 6:
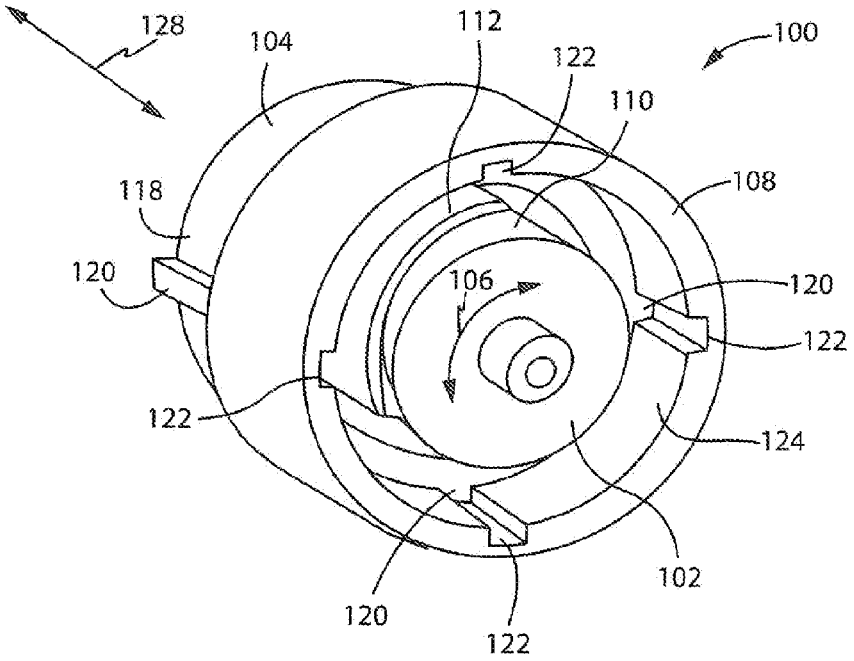
FIGS. 6 and 7 are perspective graphical representations of an exciter assembly associated with forming a water jet assembly according to another embodiment of the present invention.
Figure 7:
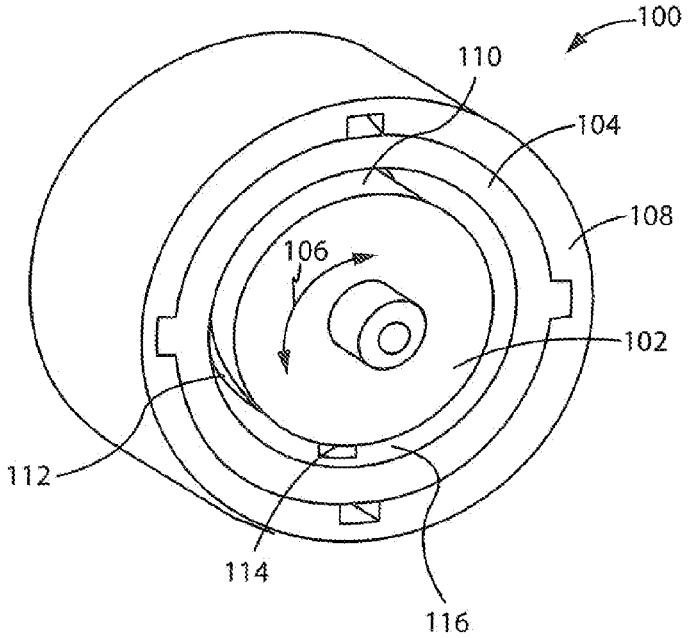

FIGS. 6 and 7 shown a first exciter drive arrangement 100 according to an alternate embodiment of the present invention. Drive arrangement 100 includes a drive element 102 and a driven element 104. Drive element 102 is configured to be driven in a rotational direction, indicated by arrow 106, relative to driven element 104 and a base or housing element 108. An outward radial surface 110 of drive element 102 includes a chase for groove 112 that extends circumferentially about outward radial surface 110 of drive element 102. A post 114 extends from a radially inward facing surface 116 of driven element 104 and slideably cooperates with groove 112 defined by drive element 102.

An outward radial surface 118 of driven element 104 includes one or more ribs 120, that slideably cooperate with a respective groove 122 associated with a radially inward facing surface 124 of housing 108. The slideable cooperation of ribs 120 and grooves 122 facilitates an axially slideable association between driven element 104 and drive element 102 and housing 108. Groove 112 associated with drive element 102 translates in an axial direction, indicated by arrow 128, along the circumference of the exterior surface 110 of drive element 102. During rotation 106 of drive element 102, the slideable cooperation between post 114 and groove 112 effectuate axial translation 128 of driven element 104 relative to drive element 102 and housing 108 thereby generating linear axial oscillation of driven element 104 in response to rotation 106 of drive element 102. The linear axial translation 128 of driven element 104 relative to housing 108 and drive element 102 generates the desired oscillation of diaphragm 116, so as to facilitate sequential generation of multiple soliton waves 30 in response to a rotational input signal associated with rotation 106 of drive element 102.

Figure 8:
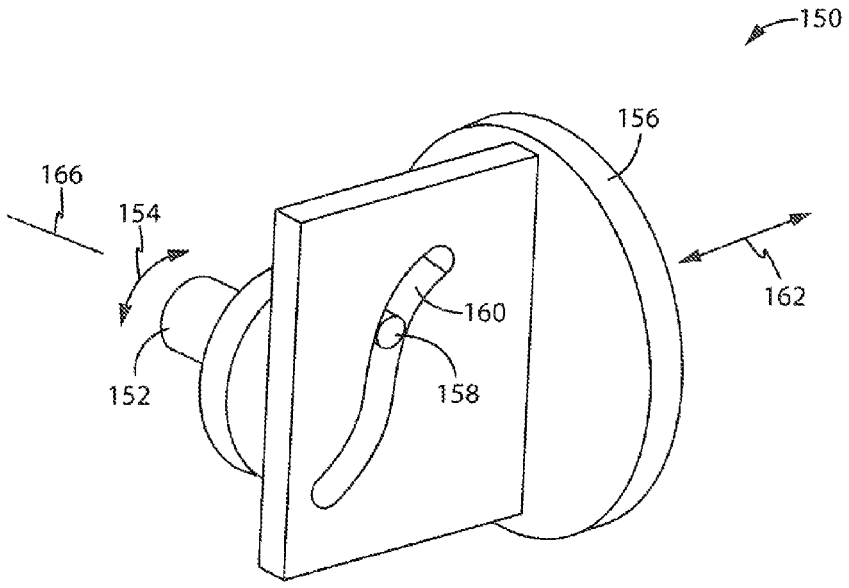
FIG. 8 is a perspective graphical representation of an exciter assembly associated with forming a water jet assembly according to another embodiment of the invention.
Figure 9:
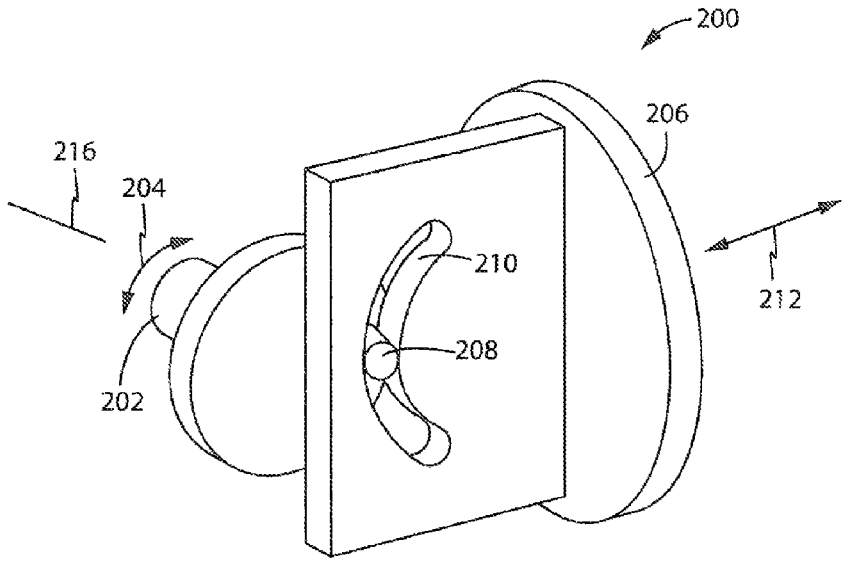
FIG. 9 is a perspective graphical representation of an exciter assembly associated with forming a water jet assembly according to another embodiment of the invention.
Figure 10:
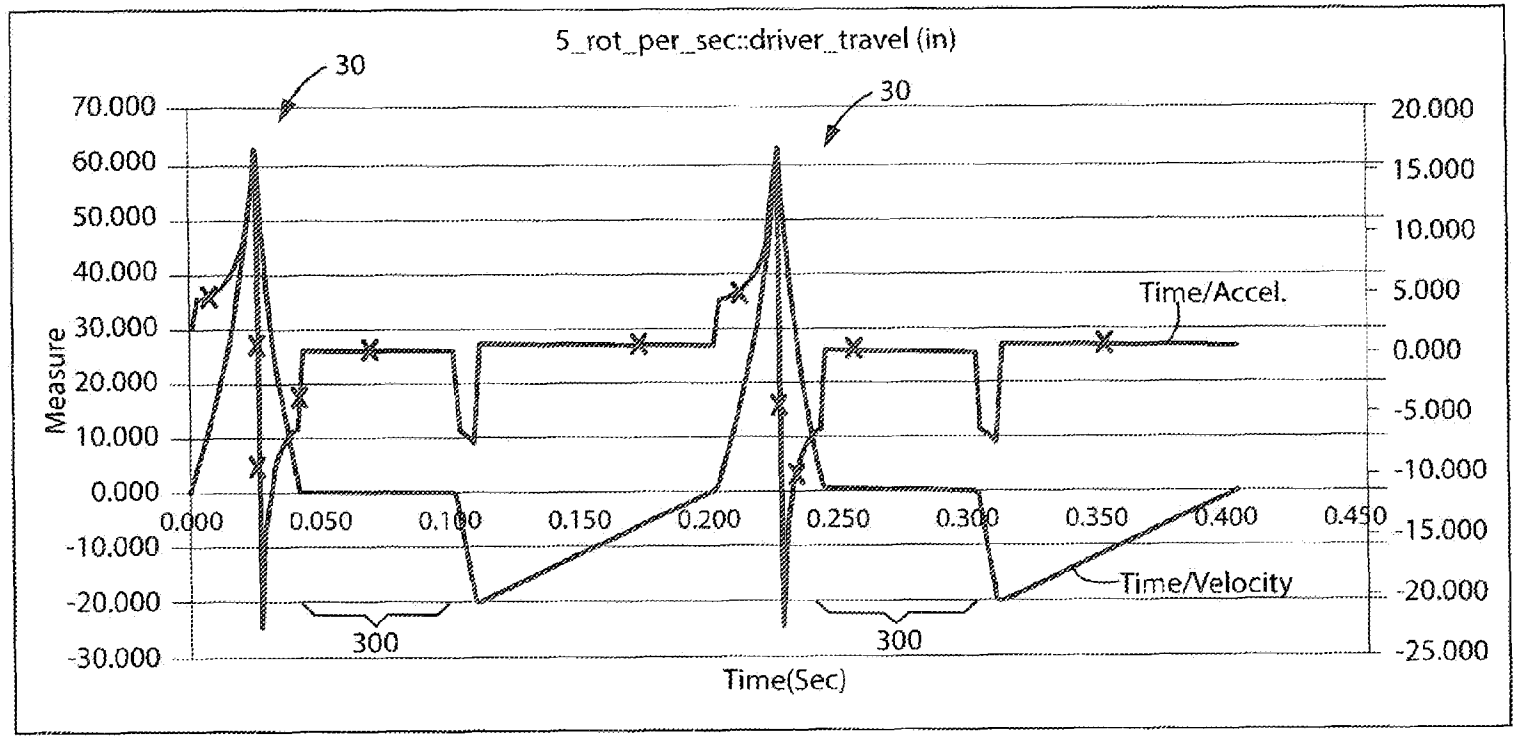
FIG. 10 is a graph showing the generation of sequential soliton waves associated with operation of a water jet assembly equipped with an exciter according to any of the above embodiments.

FIGS. 8 and 9 show alternate exciter drive arrangements, 150, 200 according to yet other embodiments of the present invention. Each drive arrangement 150, 200 includes a drive element 152, 202 that is driven in a rotational direction, indicated by arrows 154, 204, respectively, and operatively associated with a driven element 156, 206. Each drive element 152, 202 includes a post 158, 208 that slideably cooperates with a groove or channel, 160, 210 associated with the respective driven element 156, 206. Each channel 160, 210 is contoured to generate a linear axial translation, indicated by arrows 162, 212 of the respective driven element 156, 206 in response to rotation, 154, 204 of the respective drive element 152, 202. Respective posts 158, 208 are offset in a radial direction relative to the respective axis of rotation, 166, 216 of the respective drive element 152, 202, such that the slideable cooperation between posts 158, 208 with respective channels, 160, 210 effectuate the sequential axial translation, 162, 212 of the respective driven element 156, 206 and generate the desired oscillation of diaphragm 16 to facilitate sequential generation of solid time waves 30.

As compared to the embodiment shown in FIGS. 6 and 7, wherein the axis of rotation associated with drive element 102 is generally aligned with the longitudinal displacement axis 128, it should be appreciated that rotational axes 166, 216 associated with the embodiments shown in FIGS. 8 and 9 are oriented in a crossing direction relative to the axis associated with the longitudinal displacement axis 162, 212, respectively, of the driven element. Such a consideration accommodates those configurations wherein close spatial restrictions reduce the ability to utilize generally elongated exciter orientations, such as that shown in. FIG. 2. It is further appreciated that the various embodiment shown in FIGS. 6-9, are merely exemplary of various exciter drive arrangements envisioned to be utilized in the generation of soliton waves 30. It should be further appreciated that the general orientation, shape, and construction of posts 158, 208 and channels, 160, 210 are merely exemplary and that other configurations, even reverse configurations of the post and channel relative to the drive and driven elements, are envisioned for converting the rotational input associated with operation of respective drive elements 152, 202, to generate the longitudinal axial displacement, 162, 212 associated with respective driven elements 156, 206.

The table below includes the data associated with sequentially generating a plurality of soliton waves 30 according to any of the embodiments described above. The data in each successive right hand column follows the data in the immediately preceding left hand column. FIG. 11 is a graphical representation of the data presented below.

TABLE 1

| Time (Sec) | Position (in | Veloc (in/s) | Accel (g's) |
|---|---|---|---|
| 0.000 | 0.478 | | |
| 0.001 | 0.478 | 0.833 | 2.156 |
| 0.002 | 0.481 | 2.504 | 4.323 |
| 0.003 | 0.485 | 4.182 | 4.343 |
| 0.004 | 0.491 | 5.870 | 4.370 |
| 0.005 | 0.498 | 7.584 | 4.435 |
| 0.006 | 0.508 | 9.329 | 4.515 |
| 0.007 | 0.519 | 11.100 | 4.585 |
| 0.008 | 0.532 | 12.909 | 4.680 |
| 0.009 | 0.547 | 14.773 | 4.824 |
| 0.010 | 0.563 | 16.692 | 4.968 |
| 0.011 | 0.582 | 18.675 | 5.132 |
| 0.012 | 0.603 | 20.754 | 5.378 |
| 0.013 | 0.626 | 22.937 | 5.650 |
| 0.014 | 0.651 | 25.226 | 5.923 |
| 0.015 | 0.678 | 27.615 | 6.184 |
| 0.016 | 0.709 | 30.158 | 6.575 |
| 0.017 | 0.742 | 32.923 | 7.161 |
| 0.018 | 0.777 | 35.915 | 7.743 |
| 0.019 | 0.817 | 39.172 | 8.430 |
| 0.020 | 0.859 | 42.823 | 9.448 |
| 0.021 | 0.906 | 46.853 | 10.430 |
| 0.022 | 0.958 | 51.370 | 11.691 |
| 0.023 | 1.014 | 56.712 | 13.825 |
| 0.024 | 1.077 | 63.096 | 16.520 |
| 0.025 | 1.139 | 61.495 | −4.142 |
| 0.026 | 1.192 | 52.658 | −22.870 |
| 0.027 | 1.237 | 45.740 | −17.904 |
| 0.028 | 1.278 | 40.129 | −14.521 |
| 0.029 | 1.313 | 35.258 | −12.620 |
| 0.030 | 1.344 | 30.867 | −11.349 |
| 0.031 | 1.371 | 26.928 | −10.196 |
| 0.032 | 1.394 | 23.439 | −9.028 |
| 0.033 | 1.414 | 20.234 | −8.236 |
| 0.034 | 1.431 | 17.200 | −7.851 |
| 0.035 | 1.446 | 14.301 | −7.502 |
| 0.036 | 1.457 | 11.537 | −7.153 |
| 0.037 | 1.466 | 8.907 | −6.808 |
| 0.038 | 1.473 | 6.324 | −6.683 |
| 0.039 | 1.476 | 3.754 | −6.652 |
| 0.040 | 1.478 | 1.234 | −6.522 |
| 0.041 | 1.478 | 0.000 | −3.193 |
| 0.042 | 1.478 | 0.000 | 0.000 |
| 0.043 | 1.478 | 0.000 | 0.000 |
| 0.044 | 1.478 | 0.000 | 0.000 |
| 0.045 | 1.478 | 0.000 | 0.000 |
| 0.046 | 1.478 | 0.000 | 0.000 |
| 0.047 | 1.478 | 0.000 | 0.000 |
| 0.048 | 1.478 | 0.000 | 0.000 |
| 0.049 | 1.478 | 0.000 | 0.000 |
| 0.050 | 1.478 | 0.000 | 0.000 |
| 0.051 | 1.478 | 0.000 | 0.000 |
| 0.052 | 1.478 | 0.000 | 0.000 |
| 0.053 | 1.478 | 0.000 | 0.000 |
| 0.054 | 1.478 | 0.000 | 0.000 |
| 0.055 | 1.478 | 0.000 | 0.000 |
| 0.056 | 1.478 | 0.000 | 0.000 |
| 0.057 | 1.478 | 0.000 | 0.000 |
| 0.058 | 1.478 | 0.000 | 0.000 |
| 0.059 | 1.478 | 0.000 | 0.000 |
| 0.060 | 1.478 | 0.000 | 0.000 |
| 0.061 | 1.478 | 0.000 | 0.000 |
| 0.062 | 1.478 | 0.000 | 0.000 |
| 0.063 | 1.478 | 0.000 | 0.000 |
| 0.064 | 1.478 | 0.000 | 0.000 |
| 0.065 | 1.478 | 0.000 | 0.000 |
| 0.066 | 1.478 | 0.000 | 0.000 |
| 0.067 | 1.478 | 0.000 | 0.000 |
| 0.068 | 1.478 | 0.000 | 0.000 |
| 0.069 | 1.478 | 0.000 | 0.000 |
| 0.070 | 1.478 | 0.000 | 0.000 |
| 0.071 | 1.478 | 0.000 | 0.000 |
| 0.072 | 1.478 | 0.000 | 0.000 |
| 0.073 | 1.478 | 0.000 | 0.000 |

TABLE 1-continued

| Time (Sec) | Position (in | Veloc (in/s) | Accel (g's) |
|---|---|---|---|
| 0.074 | 1.478 | 0.000 | 0.000 |
| 0.075 | 1.478 | 0.000 | 0.000 |
| 0.076 | 1.478 | 0.000 | 0.000 |
| 0.077 | 1.478 | 0.000 | 0.000 |
| 0.078 | 1.478 | 0.000 | 0.000 |
| 0.079 | 1.478 | 0.000 | 0.000 |
| 0.080 | 1.478 | 0.000 | 0.000 |
| 0.081 | 1.478 | 0.000 | 0.000 |
| 0.082 | 1.478 | 0.000 | 0.000 |
| 0.083 | 1.478 | 0.000 | 0.000 |
| 0.084 | 1.478 | 0.000 | 0.000 |
| 0.085 | 1.478 | 0.000 | 0.000 |
| 0.086 | 1.478 | 0.000 | 0.000 |
| 0.087 | 1.478 | 0.000 | 0.000 |
| 0.088 | 1.478 | 0.000 | 0.000 |
| 0.089 | 1.478 | 0.000 | 0.000 |
| 0.090 | 1.478 | 0.000 | 0.000 |
| 0.091 | 1.478 | 0.000 | 0.000 |
| 0.092 | 1.478 | 0.000 | 0.000 |
| 0.093 | 1.478 | 0.000 | 0.000 |
| 0.094 | 1.478 | 0.000 | 0.000 |
| 0.095 | 1.478 | 0.000 | 0.000 |
| 0.096 | 1.478 | 0.000 | 0.000 |
| 0.097 | 1.478 | 0.000 | 0.000 |
| 0.098 | 1.478 | 0.000 | 0.000 |
| 0.099 | 1.478 | 0.000 | 0.000 |
| 0.100 | 1.478 | 0.000 | 0.000 |
| 0.101 | 1.476 | −1.246 | −3.225 |
| 0.102 | 1.472 | −3.762 | −6.511 |
| 0.103 | 1.466 | −6.308 | −6.590 |
| 0.104 | 1.457 | −8.893 | −6.688 |
| 0.105 | 1.446 | −11.546 | −6.867 |
| 0.106 | 1.431 | −14.300 | −7.126 |
| 0.107 | 1.414 | −17.192 | −7.485 |
| 0.108 | 1.394 | −20.074 | −7.459 |
| 0.109 | 1.374 | −20.620 | −1.414 |
| 0.110 | 1.353 | −20.358 | 0.680 |
| 0.111 | 1.333 | −20.096 | 0.678 |
| 0.112 | 1.313 | −19.835 | 0.676 |
| 0.113 | 1.294 | −19.574 | 0.674 |
| 0.114 | 1.274 | −19.316 | 0.668 |
| 0.115 | 1.255 | −19.062 | 0.658 |
| 0.116 | 1.237 | −18.810 | 0.652 |
| 0.117 | 1.218 | −18.559 | 0.648 |
| 0.118 | 1.200 | −18.308 | 0.649 |
| 0.119 | 1.182 | −18.056 | 0.653 |
| 0.120 | 1.164 | −17.803 | 0.655 |
| 0.121 | 1.146 | −17.550 | 0.654 |
| 0.122 | 1.129 | −17.300 | 0.649 |
| 0.123 | 1.112 | −17.053 | 0.639 |
| 0.124 | 1.095 | −16.811 | 0.627 |
| 0.125 | 1.078 | −16.571 | 0.619 |
| 0.126 | 1.062 | −16.333 | 0.617 |
| 0.127 | 1.046 | −16.093 | 0.620 |
| 0.128 | 1.030 | −15.851 | 0.628 |
| 0.129 | 1.015 | −15.607 | 0.632 |
| 0.130 | 0.999 | −15.363 | 0.632 |
| 0.131 | 0.984 | −15.121 | 0.626 |
| 0.132 | 0.969 | −14.883 | 0.617 |
| 0.133 | 0.955 | −14.649 | 0.605 |
| 0.134 | 0.940 | −14.418 | 0.597 |
| 0.135 | 0.926 | −14.188 | 0.594 |
| 0.136 | 0.912 | −13.958 | 0.597 |
| 0.137 | 0.898 | −13.724 | 0.605 |
| 0.138 | 0.885 | −13.489 | 0.608 |
| 0.139 | 0.872 | −13.254 | 0.608 |
| 0.140 | 0.859 | −13.021 | 0.604 |
| 0.141 | 0.846 | −12.790 | 0.596 |
| 0.142 | 0.833 | −12.563 | 0.588 |
| 0.143 | 0.821 | −12.338 | 0.583 |
| 0.144 | 0.809 | −12.113 | 0.582 |
| 0.145 | 0.797 | −11.888 | 0.583 |
| 0.146 | 0.785 | −11.661 | 0.587 |
| 0.147 | 0.774 | −11.434 | 0.587 |
| 0.148 | 0.763 | −11.208 | 0.584 |
| 0.149 | 0.752 | −10.984 | 0.581 |
| 0.150 | 0.741 | −10.761 | 0.577 |
| 0.151 | 0.730 | −10.539 | 0.574 |

TABLE 1-continued

| Time (Sec) | Position (in | Veloc (in/s) | Accel (g's) |
|---|---|---|---|
| 0.152 | 0.720 | −10.318 | 0.574 |
| 0.153 | 0.710 | −10.096 | 0.574 |
| 0.154 | 0.700 | −9.874 | 0.573 |
| 0.155 | 0.690 | −9.653 | 0.573 |
| 0.156 | 0.681 | −9.433 | 0.570 |
| 0.157 | 0.672 | −9.214 | 0.565 |
| 0.158 | 0.663 | −8.997 | 0.562 |
| 0.159 | 0.654 | −8.780 | 0.561 |
| 0.160 | 0.645 | −8.563 | 0.562 |
| 0.161 | 0.637 | −8.345 | 0.565 |
| 0.162 | 0.629 | −8.126 | 0.566 |
| 0.163 | 0.621 | −7.908 | 0.566 |
| 0.164 | 0.613 | −7.690 | 0.563 |
| 0.165 | 0.606 | −7.475 | 0.558 |
| 0.166 | 0.599 | −7.261 | 0.551 |
| 0.167 | 0.591 | −7.050 | 0.548 |
| 0.168 | 0.585 | −6.838 | 0.549 |
| 0.169 | 0.578 | −6.624 | 0.552 |
| 0.170 | 0.572 | −6.409 | 0.557 |
| 0.171 | 0.565 | −6.193 | 0.559 |
| 0.172 | 0.559 | −5.977 | 0.559 |
| 0.173 | 0.554 | −5.763 | 0.555 |
| 0.174 | 0.548 | −5.551 | 0.549 |
| 0.175 | 0.543 | −5.341 | 0.543 |
| 0.176 | 0.538 | −5.132 | 0.540 |
| 0.177 | 0.533 | −4.923 | 0.541 |
| 0.178 | 0.528 | −4.713 | 0.545 |
| 0.179 | 0.524 | −4.500 | 0.550 |
| 0.180 | 0.519 | −4.287 | 0.552 |
| 0.181 | 0.515 | −4.074 | 0.552 |
| 0.182 | 0.511 | −3.852 | 0.548 |
| 0.183 | 0.508 | −3.652 | 0.543 |
| 0.184 | 0.504 | −3.444 | 0.538 |
| 0.185 | 0.501 | −3.237 | 0.536 |
| 0.186 | 0.498 | −3.029 | 0.537 |
| 0.187 | 0.495 | −2.820 | 0.541 |
| 0.188 | 0.493 | −2.610 | 0.545 |
| 0.189 | 0.490 | −2.399 | 0.546 |
| 0.190 | 0.488 | −2.188 | 0.545 |
| 0.191 | 0.486 | −1.978 | 0.543 |
| 0.192 | 0.484 | −1.770 | 0.539 |
| 0.193 | 0.483 | −1.563 | 0.537 |
| 0.194 | 0.481 | −1.355 | 0.537 |
| 0.195 | 0.480 | −1.147 | 0.538 |
| 0.196 | 0.479 | −0.939 | 0.540 |
| 0.197 | 0.478 | −0.730 | 0.541 |
| 0.198 | 0.478 | −0.521 | 0.541 |
| 0.199 | 0.478 | −0.312 | 0.540 |
| 0.200 | 0.478 | −0.104 | 0.539 |
| 0.201 | 0.478 | 0.833 | 2.425 |
| 0.202 | 0.481 | 2.504 | 4.323 |
| 0.202 | 0.485 | 4.182 | 4.343 |
| 0.204 | 0.491 | 5.870 | 4.370 |
| 0.205 | 0.498 | 7.584 | 4.435 |
| 0.206 | 0.508 | 9.329 | 4.515 |
| 0.207 | 0.519 | 11.100 | 4.585 |
| 0.208 | 0.532 | 12.909 | 4.680 |
| 0.209 | 0.547 | 14.773 | 4.624 |
| 0.210 | 0.563 | 16.692 | 4.968 |
| 0.211 | 0.582 | 18.675 | 5.132 |
| 0.212 | 0.603 | 20.754 | 5.378 |
| 0.213 | 0.626 | 22.937 | 5.650 |
| 0.214 | 0.651 | 25.226 | 5.923 |
| 0.215 | 0.678 | 27.615 | 6.184 |
| 0.216 | 0.709 | 30.156 | 5.575 |
| 0.217 | 0.742 | 32.923 | 7.161 |
| 0.218 | 0.777 | 35.915 | 7.743 |
| 0.219 | 0.817 | 39.172 | 8.430 |
| 0.220 | 0.859 | 42.823 | 9.448 |
| 0.221 | 0.906 | 46.853 | 10.430 |
| 0.222 | 0.958 | 51.370 | 11.691 |
| 0.223 | 1.014 | 56.712 | 13.825 |
| 0.224 | 1.077 | 63.096 | 16.520 |
| 0.225 | 1.139 | 61.495 | −4.142 |
| 0.226 | 1.192 | 52.658 | −25.870 |
| 0.227 | 1.237 | 45.740 | −17.904 |
| 0.228 | 1.278 | 40.129 | −14.521 |
| 0.229 | 1.313 | 35.253 | −12.620 |

TABLE 1-continued

| Time (Sec) | Position (in | Veloc (in/s) | Accel (g's) |
|---|---|---|---|
| 0.230 | 1.344 | 30.867 | −11.349 |
| 0.231 | 1.371 | 26.928 | −10.196 |
| 0.232 | 1.394 | 23.439 | −9.028 |
| 0.233 | 1.414 | 20.234 | −8.296 |
| 0.234 | 1.431 | 17.200 | −7.851 |
| 0.235 | 1.446 | 14.301 | −7.502 |
| 0.236 | 1.457 | 11.537 | −7.153 |
| 0.237 | 1.466 | 8.907 | −6.808 |
| 0.238 | 1.473 | 6.324 | −6.683 |
| 0.239 | 1.476 | 3.754 | −6.652 |
| 0.240 | 1.478 | 1.234 | −6.522 |
| 0.241 | 1.478 | 0.000 | −3.193 |
| 0.242 | 1.478 | 0.000 | 0.000 |
| 0.243 | 1.478 | 0.000 | 0.000 |
| 0.244 | 1.478 | 0.000 | 0.000 |
| 0.245 | 1.478 | 0.000 | 0.000 |
| 0.246 | 1.478 | 0.000 | 0.000 |
| 0.247 | 1.478 | 0.000 | 0.000 |
| 0.248 | 1.478 | 0.000 | 0.000 |
| 0.249 | 1.478 | 0.000 | 0.000 |
| 0.250 | 1.478 | 0.000 | 0.000 |
| 0.251 | 1.478 | 0.000 | 0.000 |
| 0.252 | 1.478 | 0.000 | 0.000 |
| 0.253 | 1.478 | 0.000 | 0.000 |
| 0.254 | 1.478 | 0.000 | 0.000 |
| 0.255 | 1.478 | 0.000 | 0.000 |
| 0.256 | 1.478 | 0.000 | 0.000 |
| 0.257 | 1.478 | 0.000 | 0.000 |
| 0.258 | 1.478 | 0.000 | 0.000 |
| 0.259 | 1.478 | 0.000 | 0.000 |
| 0.260 | 1.478 | 0.000 | 0.000 |
| 0.261 | 1.478 | 0.000 | 0.000 |
| 0.262 | 1.478 | 0.000 | 0.000 |
| 0.263 | 1.478 | 0.000 | 0.000 |
| 0.264 | 1.478 | 0.000 | 0.000 |
| 0.265 | 1.478 | 0.000 | 0.000 |
| 0.266 | 1.478 | 0.000 | 0.000 |
| 0.267 | 1.478 | 0.000 | 0.000 |
| 0.268 | 1.478 | 0.000 | 0.000 |
| 0.269 | 1.478 | 0.000 | 0.000 |
| 0.270 | 1.478 | 0.000 | 0.000 |
| 0.271 | 1.478 | 0.000 | 0.000 |
| 0.272 | 1.478 | 0.000 | 0.000 |
| 0.273 | 1.478 | 0.000 | 0.000 |
| 0.274 | 1.478 | 0.000 | 0.000 |
| 0.275 | 1.478 | 0.000 | 0.000 |
| 0.276 | 1.478 | 0.000 | 0.000 |
| 0.277 | 1.478 | 0.000 | 0.000 |
| 0.278 | 1.478 | 0.000 | 0.000 |
| 0.279 | 1.478 | 0.000 | 0.000 |
| 0.280 | 1.478 | 0.000 | 0.000 |
| 0.281 | 1.478 | 0.000 | 0.000 |
| 0.282 | 1.478 | 0.000 | 0.000 |
| 0.283 | 1.478 | 0.000 | 0.000 |
| 0.284 | 1.478 | 0.000 | 0.000 |
| 0.285 | 1.478 | 0.000 | 0.000 |
| 0.286 | 1.478 | 0.000 | 0.000 |
| 0.287 | 1.478 | 0.000 | 0.000 |
| 0.288 | 1.478 | 0.000 | 0.000 |
| 0.289 | 1.478 | 0.000 | 0.000 |
| 0.290 | 1.478 | 0.000 | 0.000 |
| 0.291 | 1.478 | 0.000 | 0.000 |
| 0.292 | 1.478 | 0.000 | 0.000 |
| 0.293 | 1.478 | 0.000 | 0.000 |
| 0.294 | 1.478 | 0.000 | 0.000 |
| 0.295 | 1.478 | 0.000 | 0.000 |
| 0.296 | 1.478 | 0.000 | 0.000 |
| 0.297 | 1.478 | 0.000 | 0.000 |
| 0.298 | 1.478 | 0.000 | 0.000 |
| 0.299 | 1.478 | 0.000 | 0.000 |
| 0.300 | 1.478 | 0.000 | 0.000 |
| 0.301 | 1.476 | −1.246 | −3.225 |
| 0.302 | 1.472 | −3.762 | −6.511 |
| 0.303 | 1.466 | −6.308 | −6.590 |
| 0.304 | 1.457 | −8.893 | −6.688 |
| 0.305 | 1.446 | −11.546 | −6.867 |
| 0.306 | 1.431 | −14.300 | −7.126 |
| 0.307 | 1.414 | −17.192 | −7.485 |

TABLE 1-continued

| Time (Sec) | Position (in | Veloc (in/s) | Accel (g's) |
|---|---|---|---|
| 0.308 | 1.394 | −20.074 | −7.459 |
| 0.309 | 1.374 | −20.620 | −1.414 |
| 0.310 | 1.353 | −20.358 | 0.680 |
| 0.311 | 1.333 | −20.096 | 0.678 |
| 0.312 | 1.313 | −19.835 | 0.676 |
| 0.313 | 1.294 | −19.574 | 0.674 |
| 0.314 | 1.274 | −19.316 | 0.668 |
| 0.315 | 1.255 | −19.062 | 0.658 |
| 0.316 | 1.237 | −18.810 | 0.652 |
| 0.317 | 1.218 | −18.559 | 0.648 |
| 0.318 | 1.200 | −18.308 | 0.649 |
| 0.319 | 1.182 | −18.056 | 0.653 |
| 0.320 | 1.164 | −17.803 | 0.655 |
| 0.321 | 1.146 | −17.550 | 0.654 |
| 0.322 | 1.129 | −17.300 | 0.649 |
| 0.323 | 1.112 | −17.053 | 0.639 |
| 0.324 | 1.095 | −16.811 | 0.627 |
| 0.325 | 1.078 | −16.571 | 0.619 |
| 0.326 | 1.062 | −16.333 | 0.617 |
| 0.327 | 1.046 | −16.093 | 0.620 |
| 0.328 | 1.030 | −15.851 | 0.628 |
| 0.329 | 1.015 | −15.607 | 0.632 |
| 0.330 | 0.999 | −15.363 | 0.632 |
| 0.331 | 0.984 | −15.121 | 0.626 |
| 0.332 | 0.969 | −14.883 | 0.617 |
| 0.333 | 0.955 | −14.649 | 0.605 |
| 0.334 | 0.940 | −14.418 | 0.597 |
| 0.335 | 0.926 | −14.188 | 0.594 |
| 0.336 | 0.912 | −13.958 | 0.597 |
| 0.337 | 0.898 | −13.724 | 0.605 |
| 0.338 | 0.885 | −13.489 | 0.608 |
| 0.339 | 0.872 | −13.254 | 0.608 |
| 0.340 | 0.859 | −13.021 | 0.604 |
| 0.341 | 0.846 | −12.790 | 0.596 |
| 0.342 | 0.833 | −12.563 | 0.588 |
| 0.343 | 0.821 | −12.338 | 0.563 |
| 0.344 | 0.809 | −12.113 | 0.582 |
| 0.345 | 0.797 | −11.888 | 0.583 |
| 0.346 | 0.785 | −11.661 | 0.587 |
| 0.347 | 0.774 | −11.434 | 0.587 |
| 0.348 | 0.763 | −11.208 | 0.584 |
| 0.349 | 0.752 | −10.984 | 0.581 |
| 0.350 | 0.741 | −10.761 | 0.577 |
| 0.351 | 0.730 | −10.539 | 0.574 |
| 0.352 | 0.720 | −10.318 | 0.574 |
| 0.353 | 0.710 | −10.096 | 0.574 |
| 0.354 | 0.700 | −9.874 | 0.573 |
| 0.355 | 0.690 | −9.653 | 0.573 |
| 0.356 | 0.681 | −9.433 | 0.570 |
| 0.357 | 0.672 | −9.214 | 0.565 |
| 0.358 | 0.663 | −8.997 | 0.562 |
| 0.359 | 0.654 | −8.780 | 0.561 |
| 0.360 | 0.645 | −8.563 | 0.562 |
| 0.361 | 0.637 | −8.345 | 0.565 |
| 0.362 | 0.629 | −8.126 | 0.566 |
| 0.363 | 0.621 | −7.908 | 0.566 |
| 0.364 | 0.613 | −7.690 | 0.563 |
| 0.365 | 0.606 | −7.475 | 0.558 |
| 0.366 | 0.599 | −7.261 | 0.551 |
| 0.367 | 0.591 | −7.050 | 0.548 |
| 0.368 | 0.585 | −6.838 | 0.549 |
| 0.369 | 0.578 | −6.624 | 0.552 |
| 0.370 | 0.572 | −6.409 | 0.557 |
| 0.371 | 0.565 | −6.193 | 0.559 |
| 0.372 | 0.559 | −5.977 | 0.559 |
| 0.373 | 0.554 | −5.763 | 0.555 |
| 0.374 | 0.548 | −5.551 | 0.549 |
| 0.375 | 0.543 | −5.341 | 0.543 |
| 0.376 | 0.538 | −5.132 | 0.540 |
| 0.377 | 0.533 | −4.923 | 0.541 |
| 0.378 | 0.528 | −4.713 | 0.545 |
| 0.379 | 0.524 | −4.500 | 0.550 |
| 0.380 | 0.519 | −4.287 | 0.552 |
| 0.381 | 0.515 | −4.074 | 0.552 |
| 0.382 | 0.511 | −3.862 | 0.548 |
| 0.383 | 0.508 | −3.652 | 0.543 |
| 0.384 | 0.504 | −3.444 | 0.538 |
| 0.385 | 0.501 | −3.237 | 0.536 |

TABLE 1-continued

| Time (Sec) | Position (in | Veloc (in/s) | Accel (g's) |
|---|---|---|---|
| 0.386 | 0.498 | −3.029 | 0.537 |
| 0.387 | 0.495 | −2.820 | 0.541 |
| 0.388 | 0.493 | −2.610 | 0.545 |
| 0.389 | 0.490 | −2.399 | 0.546 |
| 0.390 | 0.488 | −2.188 | 0.545 |
| 0.391 | 0.486 | −1.978 | 0.543 |
| 0.392 | 0.484 | −1.770 | 0.539 |
| 0.393 | 0.483 | −1.563 | 0.537 |
| 0.394 | 0.481 | −1.359 | 0.537 |
| 0.395 | 0.480 | −1.147 | 0.538 |
| 0.396 | 0.479 | −0.939 | 0.540 |
| 0.397 | 0.478 | −0.730 | 0.541 |
| 0.398 | 0.478 | −0.521 | 0.541 |
| 0.399 | 0.478 | −0.312 | 0.540 |
| 0.400 | 0.478 | −0.104 | 0.539 |

Referring to FIG. 11, a soliton wave 30 associated with the maximum acceleration and velocity data, is generated for each rotation or axial translation of the exciter drive arrangement associated with any of the above embodiments described above. As shown therein, a delay or dwell event 300 is provided immediately after generation of each soliton wave to mitigate detraction from the energy associated with each wave caused by subsequent oscillation of the diaphragm 16 necessary for generation of subsequent soliton waves. It should be appreciated that the physical arrangement and cooperation between the respective elements of any of the exciter drive arrangements described above can be manipulated so as to manipulate the amplitude associated with each solid time wave and the timing associated with subsequent wave generation. Such considerations allow each exciter drive arrangement to be configured to generate a soliton wave having a desired magnitude and sequencing.

The present invention has been described in terms of the preferred embodiment. The several embodiments disclosed herein are related as being related to the assembly as generally shown in the drawings. It is recognized that equivalents, alternatives, and modifications, aside from those expressly stated, the embodiments summarized, or the embodiment shown in the drawings, are possible and within the scope of the appending claims. The appending claims cover all such alternatives and equivalents.

What is claimed is:

1. A water jet assembly comprising:

a faceplate that defines an inlet and an outlet;

a base constructed to cooperate with the faceplate;

a diaphragm disposed between the base and the faceplate and configured to cooperate with the faceplate to be movable between a first position wherein the diaphragm is oriented adjacent an inward facing surface of the faceplate to obstruct both the inlet and the outlet defined by the faceplate and prevent passage of a fluid through the faceplate via either of the inlet and the outlet and a second position offset from the faceplate to define a volume therebetween; and an exciter connected to the base and configured to excite the diaphragm to move fluid from the inlet to the outlet during operation of the exciter and such that the diaphragm occupies the volume when the exciter is off.

2. The water jet assembly of claim 1 wherein the inlet and outlet associated with the faceplate are shaped and oriented to generate a torroidal waveform associated with operation of the exciter.

3. The water jet assembly of claim h comprising a seal disposed between the faceplate and the base.

4. The water jet assembly of claim 3 wherein the seal is disposed circumferentially about the diaphragm.

5. The water jet assembly of claim l further comprising a flap assembly hat includes at least one tab that movably cooperates with the outlet.

6. The water jet assembly of claim 5 further comprising at least one of a silver layer or an antibacterial coating applied to surfaces that define the volume.

7. The water jet assembly of claim 1 wherein the exciter is further defined as one of a solenoid, a piston pump, a linear actuator, a rotational actuator, and a speaker coil.

8. A water jet assembly comprising:

a faceplate that defines a plurality of inlets that are oriented radially about at least one outlet;

a housing constructed to cooperate with the faceplate such that a first surface of the faceplate faces a basin and an inward facing surface of the faceplate faces the housing;

a diaphragm that is movable between a first position and a second position and disposed between the housing and the faceplate, the diaphragm obstructing the plurality of inlets and the at least one outlet via direct contact with the inward facing surface of the faceplate when in the first position and defining a fluid passage between the diaphragm and the faceplate that extends between the plurality of inlets and the at least one outlet when the diaphragm is in the second position; and an exciter supported by the housing and configured to oscillate the diaphragm between the first position and the second position to move fluid from the plurality of inlets to the outlet via the fluid passage during operation of the exciter and such that the diaphragm obstructs the plurality of inlets and the at least one outlet when the exciter is off.

9. The water jet assembly of claim 8 wherein the plurality of inlets are circumferentially spaced from one another and each located radially outboard of the at least one outlet.

10. The water jet assembly of claim 9 wherein each inlet defined by the faceplate is contoured to draw water from an outward radial direction and the at least one outlet is contoured to expel water in a direction that is generally normal to a plane defined by the faceplate.

11. The water jet assembly of claim 10 wherein the at least one outlet is generally ring shaped and configured to generate a toroidal soliton wave during each oscillation of the diaphragm.

12. The water jet assembly of claim 11 further comprising a controller configured to control operation of the exciter to allow the toroidal soliton wave to propagate a distance in the direction that is generally normal to the plane defined by the faceplate sufficient to mitigate interference with the toroidal soliton wave by a flow of water drawn into the plurality of inlets.

13. The water jet assembly of claim 11 wherein the exciter is further defined as at least one of a solenoid, a piston pump, a linear actuator, a rotational actuator, and a speaker coil.

14. A method of forming a water jet flow, the method comprising:

drawing water through an inlet defined by a faceplate into a variable volume chamber of a jet assembly and expelling water through an outlet defined by the faceplate out of the variable volume chamber of the jet assembly by operation of an exciter; and occupying a volume of the chamber with a diaphragm that closes each of the inlet and outlet via direct contact of the diaphragm with an interior facing surface of the faceplate when the exciter is off.

15. The method of claim 14 further comprising forming the exciter as one of a linear actuator, a rotational actuator, a piston pump, a solenoid, or a speaker coil.

16. The method of claim 14 further comprising disposing a diaphragm in the variable volume chamber and moving the diaphragm via operation of the exciter.

17. The method of claim 16 further comprising forming the faceplate to overlie the diaphragm such that the inlet and the outlet are in selective fluid communication with one another during operation of the exciter.

18. The method of claim 14 further comprising attaching at least one of the jet assemblies to a wall of a basin.

19. The method of claim 18 further comprising attaching a plurality of jet assemblies to the wall of the basin.

20. The method of claim 18 further comprising coating a surface of the variable volume chamber with at least one of a silver material or an antibacterial material.

* * * * *